US009828752B2

(12) United States Patent
Genord et al.

(10) Patent No.: US 9,828,752 B2
(45) Date of Patent: Nov. 28, 2017

(54) HANDHELD SHOWER DOCKING ARRANGEMENT

(75) Inventors: Daniel S. Genord, South Lyon, MI (US); Michael Miller, Portage, MI (US); Dominic J. Daunter, Howell, MI (US); Julian Giggs, Hillsdale, MI (US); Victor Hoernig, Lowell, IN (US); Charles Patterson, Durango, CO (US)

(73) Assignee: Delta Faucet Company, Indianapolis, IN (US)

( * ) Notice: Subject to any disclaimer, the term of this patent is extended or adjusted under 35 U.S.C. 154(b) by 2117 days.

(21) Appl. No.: 12/166,583

(22) Filed: Jul. 2, 2008

(65) Prior Publication Data

US 2009/0007330 A1 Jan. 8, 2009

Related U.S. Application Data

(60) Provisional application No. 60/958,412, filed on Jul. 5, 2007.

(51) Int. Cl.

| | |
|---|---|
| ***E03C 1/042*** | (2006.01) |
| ***E03C 1/06*** | (2006.01) |
| ***B05B 1/18*** | (2006.01) |
| ***B05B 15/06*** | (2006.01) |
| ***E03C 1/04*** | (2006.01) |
| *B05B 1/16* | (2006.01) |

(52) U.S. Cl.

CPC ..... *E03C 1/06* (2013.01); *B05B 1/18* (2013.01); *B05B 15/061* (2013.01); *E03C 1/0408* (2013.01); *B05B 1/16* (2013.01)

(58) Field of Classification Search

CPC ..... E03C 1/0401
USPC ..... 4/695, 615
See application file for complete search history.

(56) References Cited

U.S. PATENT DOCUMENTS

| | | | | |
|---|---|---|---|---|
| 6,446,278 | B1 * | 9/2002 | Lin | 4/615 |
| 7,900,295 | B2 * | 3/2011 | Lev | 4/615 |
| 2003/0041372 | A1 | 3/2003 | Yang | |
| 2007/0022528 | A1 * | 2/2007 | Gilbert | 4/615 |

FOREIGN PATENT DOCUMENTS

| | | |
|---|---|---|
| DE | 19649006 | 5/1998 |
| EP | 1367183 | 12/2003 |
| GB | 2285919 | 8/1995 |
| GB | 2431861 | 5/2007 |
| WO | 2005026457 | 3/2005 |
| WO | 2006025875 | 3/2006 |

OTHER PUBLICATIONS

Partial European Search Report, dated Jun. 5, 2009.

* cited by examiner

*Primary Examiner* — Lori Baker
(74) *Attorney, Agent, or Firm* — Carlson, Gaskey & Olds, P.C.

(57) ABSTRACT

An example shower assembly includes a base, a moveable spray head, a magnet, and a member attractable to the magnet. The magnet attracts the member to hold the moveable spray head relative to the base.

16 Claims, 7 Drawing Sheets

HANDHELD SHOWER DOCKING ARRANGEMENT

CROSS-REFERENCE TO RELATED APPLICATIONS

This application claims priority to U.S. Provisional Application No. 60/958,412, which was filed on 5 Jul. 2007 and is incorporated herein by reference.

BACKGROUND

This application relates to an arrangement for securing a handheld shower.

As known, bathing areas frequently include a shower assembly. Moving water through apertures in a showerhead of the shower assembly generates a showering spray of water within a bathing area. Adjusting the position of the shower assembly adjusts the spray of water. Adjustments include changing the size of the apertures, the water flow through the showerhead, or both.

Some shower assemblies include a handheld shower, which can direct a spray of water separate from the spray of water exiting the showerhead. The handheld shower is typically removeably mounted or docked to another portion of the shower assembly. A user undocks and moves the handheld shower within the bathing area to change the direction and location of the spray of water. Some of these shower assemblies deliver water to the bathing area through both the showerhead and the handheld shower.

As known, the handheld shower moves between mounted and unmounted positions in a wet, often slippery, environment. Complex handheld shower mounting arrangements can provide a secure connection between the handheld shower and the other portions of the shower assembly, but such connections are often are costly and difficult to clean. Many handheld shower mounting arrangements are also complex and difficult to install.

SUMMARY

An example shower assembly includes a base, a moveable spray head, a magnet, and a member attractable to the magnet. The magnet attracts the member to hold the moveable spray head relative to the base.

An example docking arrangement for a handheld shower includes a base, a handheld shower extending longitudinally in a first direction, and a tapered section that tapers from a first width to a second width smaller than the first width. At least one of the base and the handheld shower includes the tapered section. The other of the base and the handheld shower defines a slot that receives the tapered section. The handheld shower contacts the base to limit movement of the handheld shower away from the base when the tapered section is moved in the first direction within the slot.

An example handheld shower docking arrangement includes a handheld shower having a neck portion and a head portion. A fixed portion holds the handheld shower. The fixed portion defines a notch for receiving the neck portion and an open area for receiving the head portion. The handheld shower contacts the fixed portion to limit movement of the handheld shower away from the base when the handheld shower is moved within the notch in a first direction.

These and other features of the example disclosure can be best understood from the following specification and drawings, the following of which is a brief description:

DETAILED DESCRIPTION OF THE PREFERRED EMBODIMENT

Figure 1:
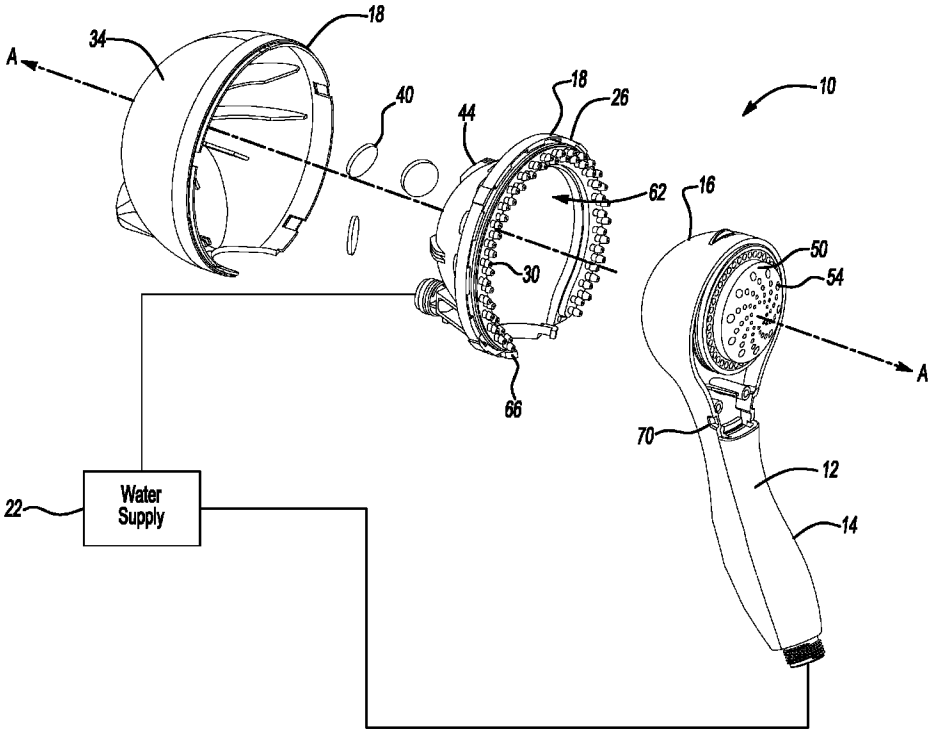
FIG. 1 illustrates an exploded view of an example shower assembly.
Figure 2A:
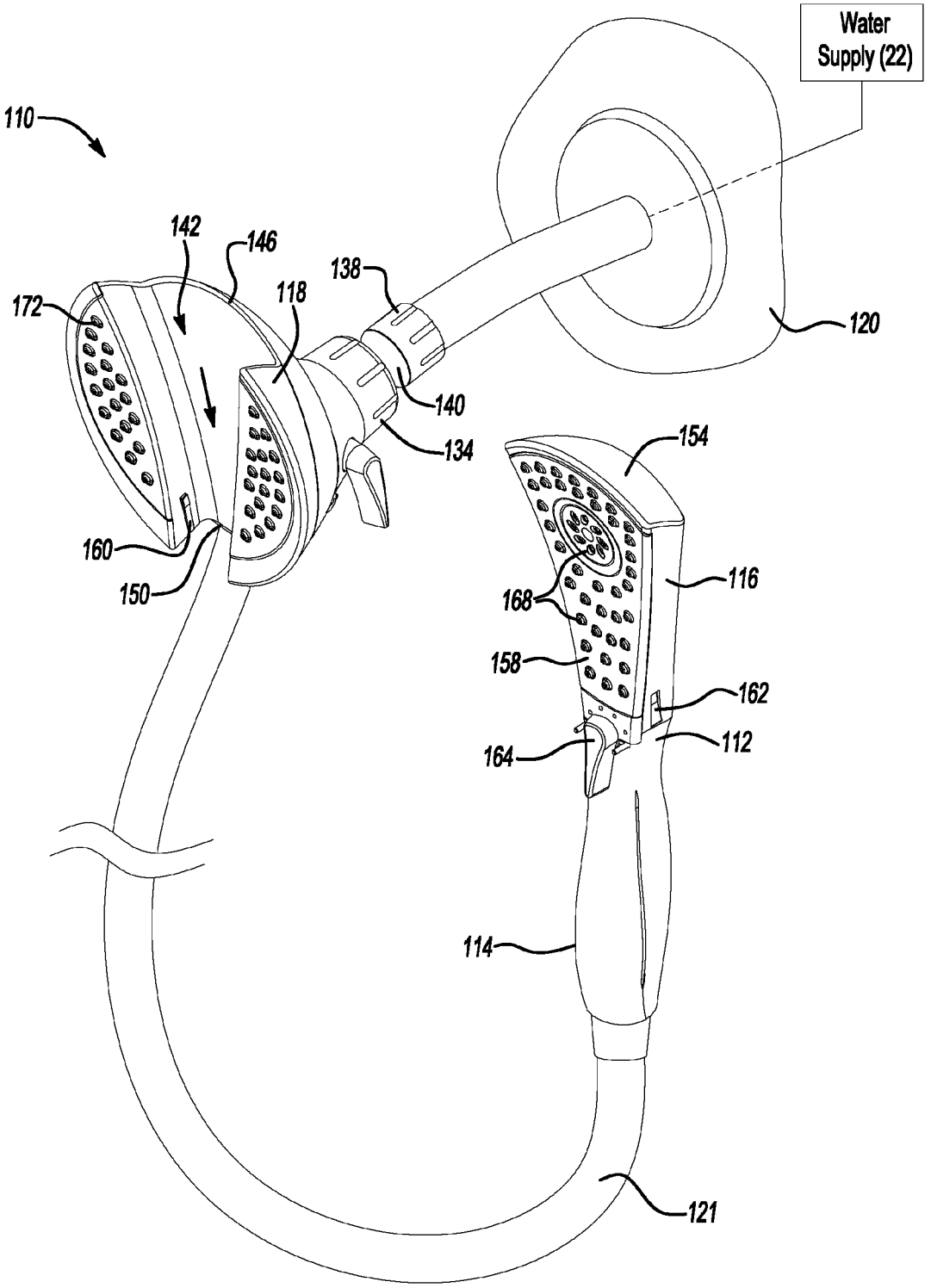
FIG. 2A illustrates a perspective view of another example shower assembly in a disengaged position.
Figure 2B:
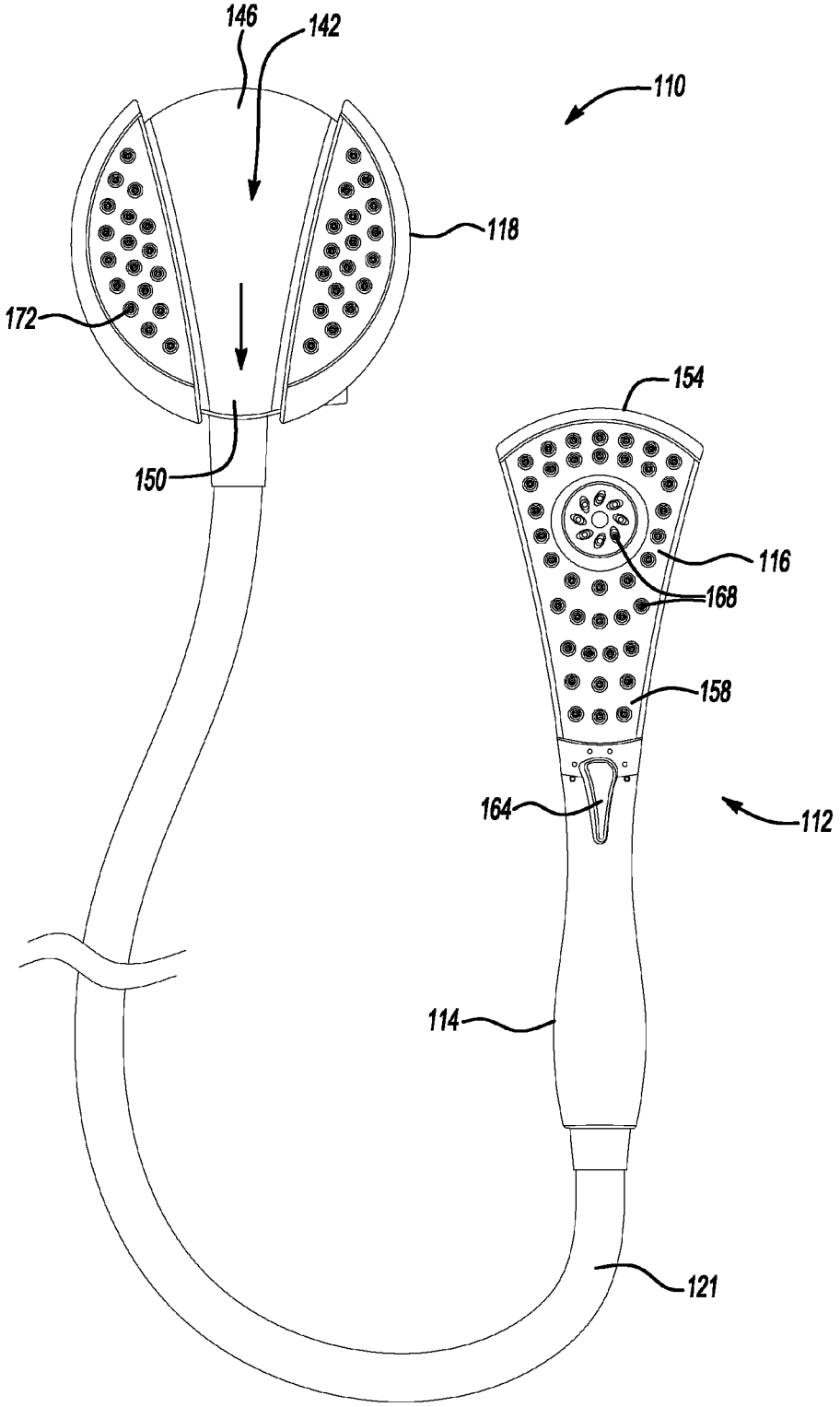
FIG. 2B illustrates a front view of the FIG. 2A shower assembly.
Figure 3A:
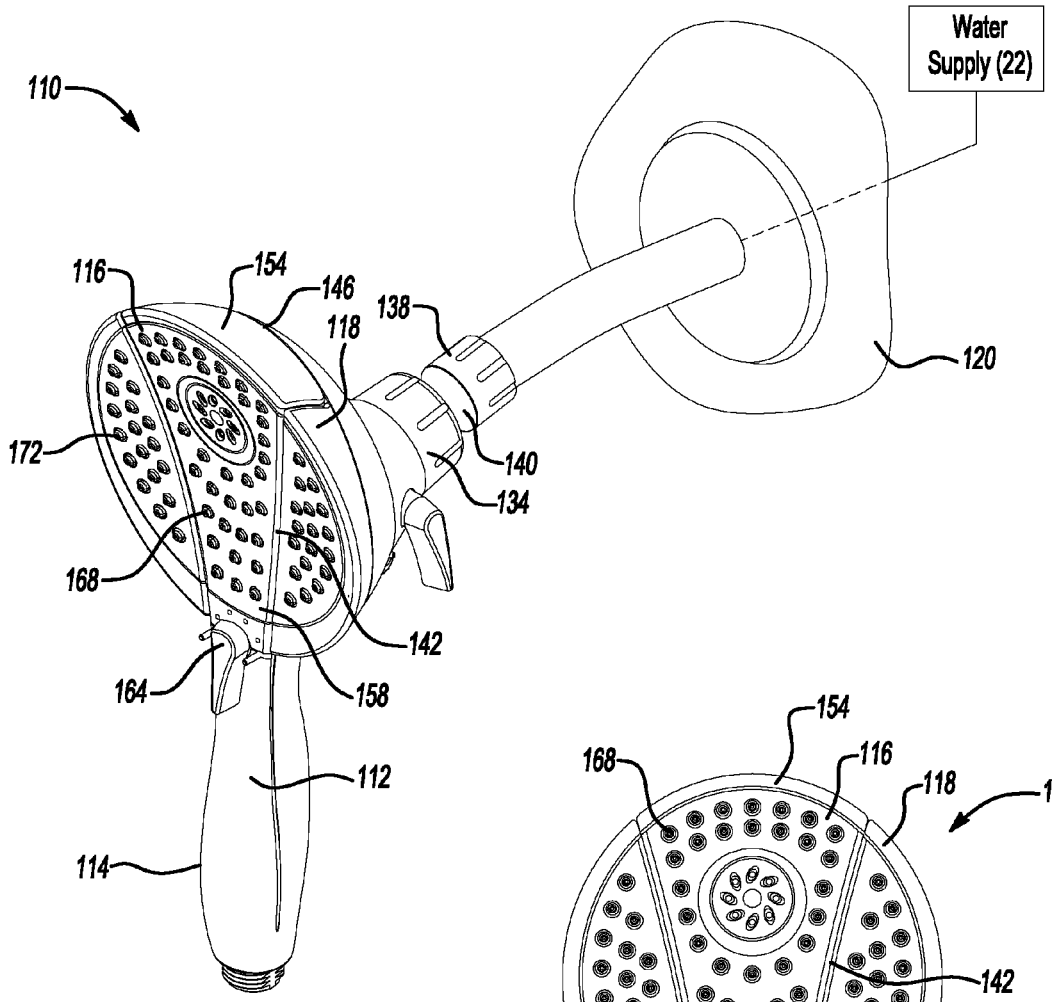
FIG. 3A illustrates a perspective view of the FIG. 2A shower assembly in an engaged position without a conduit.
Figure 3B:
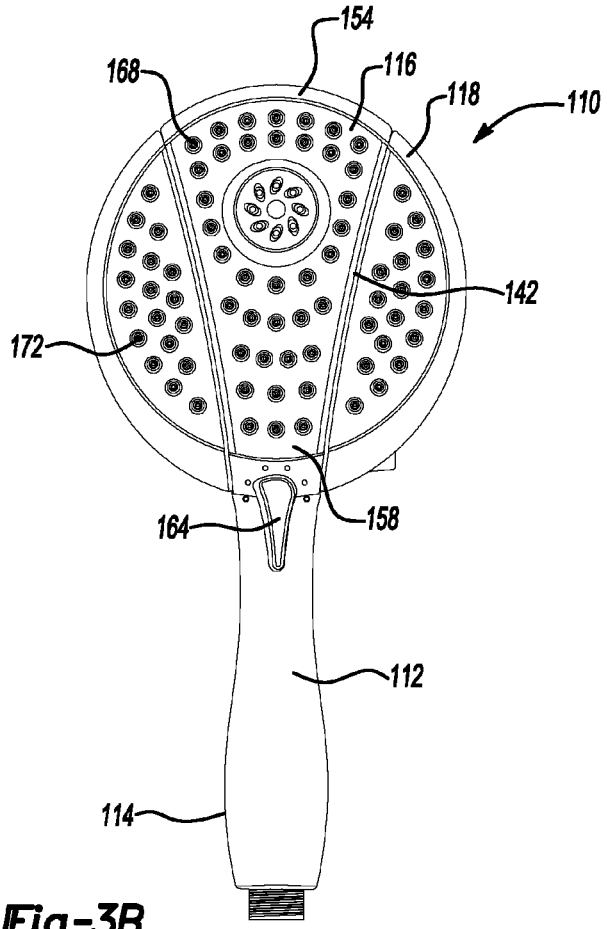
FIG. 3B illustrates a front view of the FIG. 3A shower assembly.
Figure 4A:
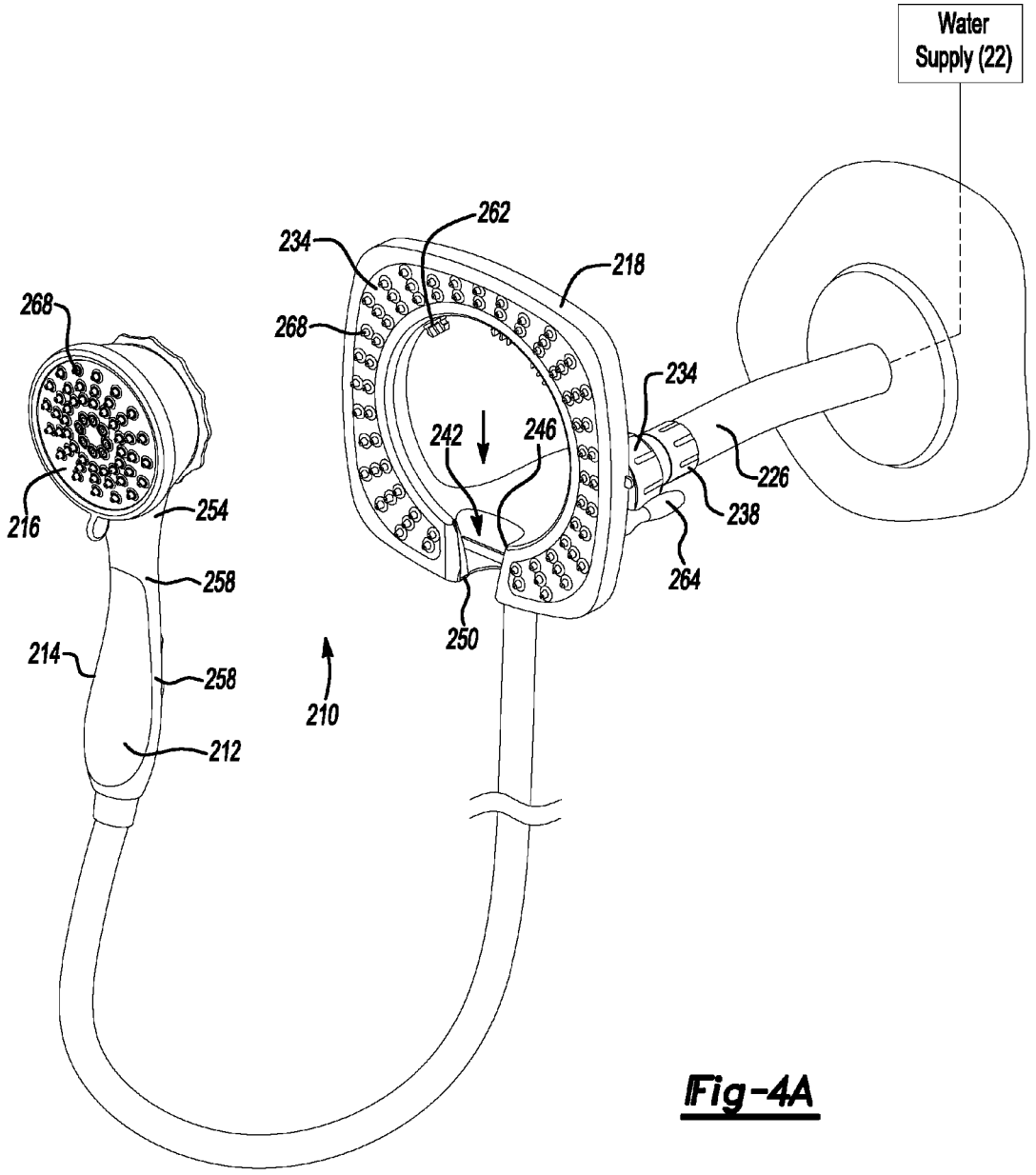
FIG. 4A illustrates a perspective view of another example shower assembly in a disengaged position.
Figure 4B:
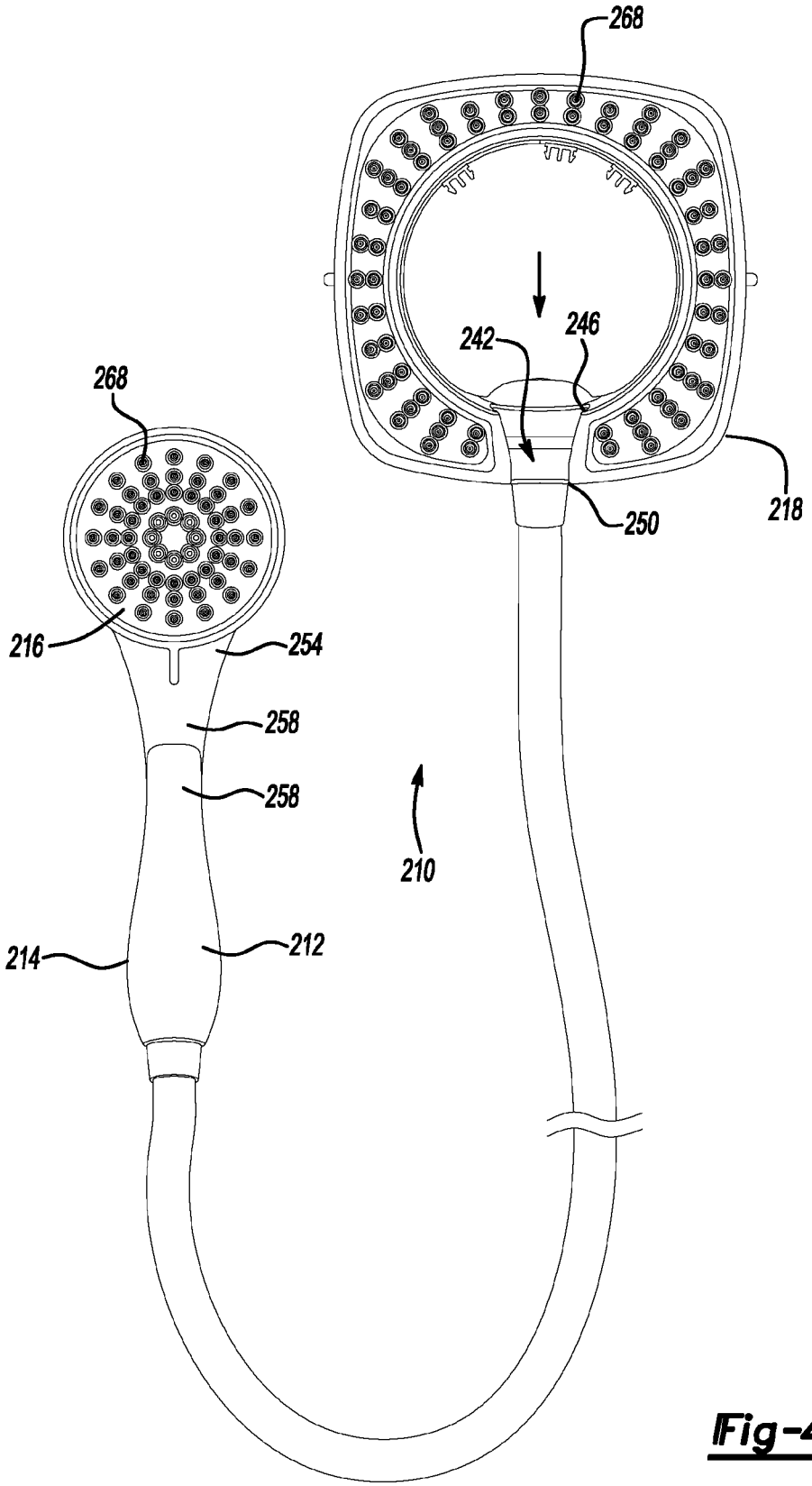
FIG. 4B illustrates a front view the FIG. 4A shower assembly.
Figure 5A:
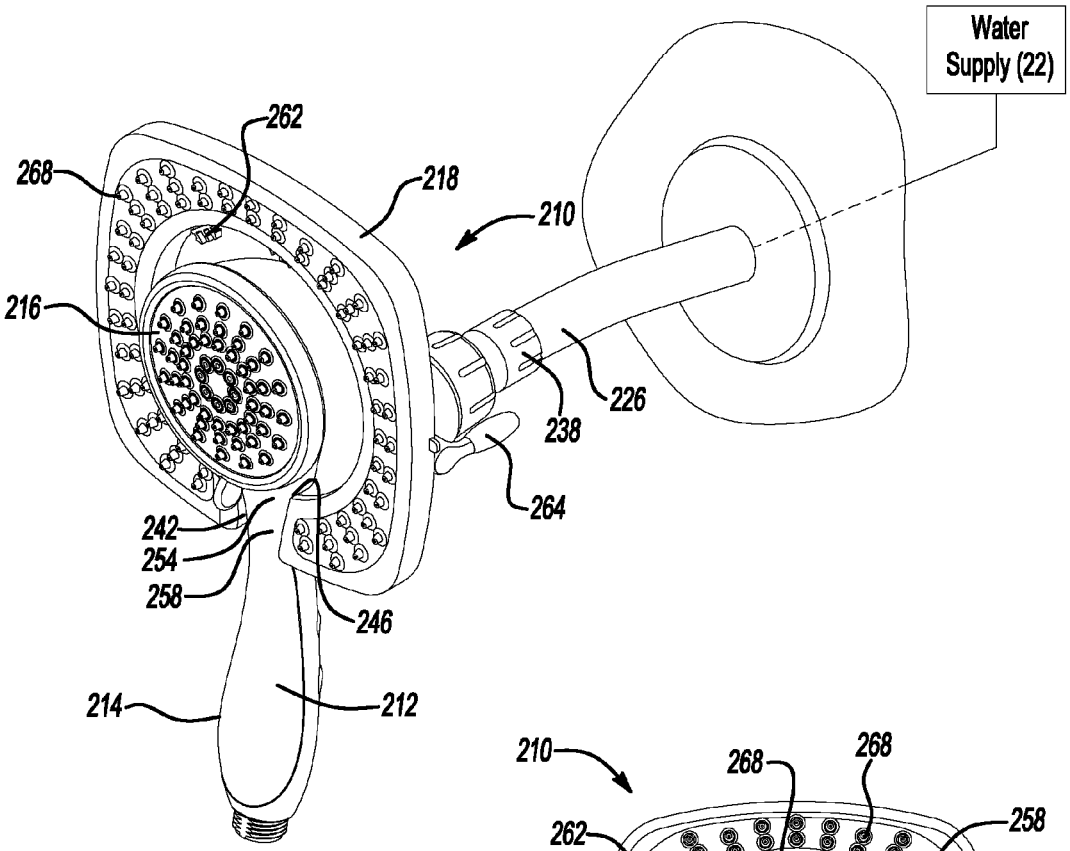
FIG. 5A illustrates a perspective view of the FIG. 4A shower assembly in an engaged position without a conduit.
Figure 5B:
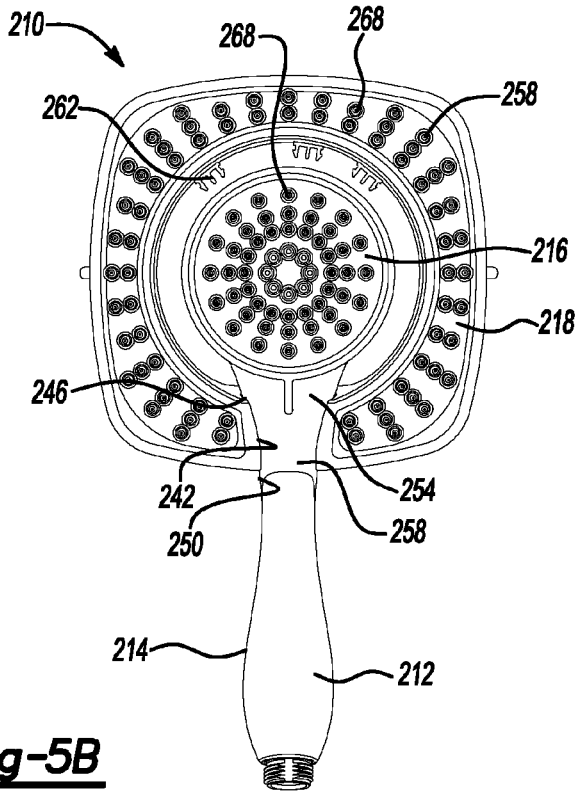
FIG. 5B illustrates a front view the FIG. 5A shower assembly.

Referring to FIG. 1, an example shower assembly 10 includes a handheld shower 12 having a handle 14 extending from a moveable spray head 16. The handheld shower 12 removeably engages or docks with a fixed spray head 18, a type of showerhead or base. A water supply 22 provides water to the moveable spray head 16 and the fixed spray head 18.

The fixed spray head 18 includes a cover portion 34 that is secured to a fixed location within a bathing area. A spray portion 26 of the fixed spray head 18 attaches to the cover portion 34 in a known manner. Water moves through a first plurality of apertures 30 within the spray portion 26 of the fixed spray head 18 to generate a spray of water within the bathing area. In one example, the fixed spray head 18 is pivotably attached within the bathing area.

The example fixed spray head 18 holds at least one magnet 40. In this example, the magnet 40 is positioned between the spray portion 26 and the cover portion 34 of the fixed spray head 18. The fixed spray head 18 is typically a polymer material and defines at least one recess 44 that accommodates and maintains the position of the magnet 40 relative other components. The magnet 40 generates a magnetic field extending from the fixed spray head 18.

In this example, the handheld shower 12 includes a plate 50, a type of member, defining a second plurality of apertures 54. Water moves from the water supply 22 through the apertures 54 to provide a spray of water within the bathing area. The plate 50 is typically a metallic material and threadably attaches to the moveable spray head 16, for example. Other examples utilize adhesive to secure the plate 50 to the moveable spray head 16. In still other examples, the plate 50 is housed within the handheld shower 12 and does not define the apertures 54.

The magnet 40 attracts the plate 50 toward the fixed spray head 18 to hold the handheld shower 12 relative to the fixed spray head 18. In this example, the magnet 40 holds the moveable spray head 16 within a recessed area 62 of the fixed spray head 18.

In one example, a user moves the moveable spray head 16 from the recessed area 62 by moving the handle 14 to guide the moveable spray head 16 away from the fixed spray head 18 along an axis A. Other arrangements of the magnet 40 are possible and fall within the scope of this disclosure. For example, the moveable spray head 16 may include the magnet 40, which is then attracted to metal within the fixed spray head 18.

A person skilled in the art and having the benefit of this disclosure would be able to select the magnet 40 having sufficient magnetic force for holding the moveable spray head 16 within the recessed area 62 while still permitting the user to remove the moveable spray head 16 when applying force to the handle 14.

In addition to the magnet 40, the example shower assembly 10 includes a plurality of clips 66 receivable within respective grooves 70. In this example, opposing sides of the fixed spray head 18 each define one of the clips 66 and opposing sides of the moveable spray head each define one of the grooves 70. When the moveable spray head 16 is received within the recessed area 62, the clips 66 are received within the grooves 70. In this position, the clips 66 contact the portions of the moveable spray head 16 defining the grooves 70 to hold the position of the moveable spray head 16 relative to the fixed spray head 18. When the user desires to move the moveable spray head 16 relative to the fixed spray head 18, the user applies force to the handle 14 to flex the clips 66 out of the grooves 70, which allows movement of the moveable spray head 16 away from the recessed area 62 of the fixed spray head 18. Although described in this example as including both magnets 40 and clips 66, other examples may include only clips 66 or only magnets 40. That is, the shower assembly 10 includes the magnets 40, the clips 66, or both.

Referring now to FIGS. 2A-3B, another example shower assembly 110 includes a handheld shower 112 having a handle 114 extending from a moveable spray head 116. The handheld shower 112 removeably mounts or docks to a fixed spray head 118, a type of base. The fixed spray head 118 mounts to a bathing area wall 120. The water supply 22 delivers water to the moveable spray head 116 and the fixed spray head 118 through the bathing area wall 120. A flexible conduit 121 communicates water to the moveable spray head 116 from the fixed spray head 118.

A mounting bracket 134 secures the fixed spray head 118 relative to the bathing area wall 120. In this example, the mounting bracket 134 includes a threaded connection 138 and a pivot 140, which facilitates pivoting portions of the fixed spray head 118 relative to the bathing area wall 120.

The fixed spray head 118 defines a slot 142 for receiving the moveable spray head 116 of the handheld shower 112. The slot 142 tapers from a wider end portion 146 to a narrower end portion 150. The moveable spray head 116 similarly tapers from a wider end portion 154 to a narrower end portion 158. In this example, the profile of the moveable spray head 116 is the same general profile as that of the slot 142. Other examples include other types of tapered and wedged relationships between the handheld shower 112 and the fixed spray head 118. For example, another arrangement may include tapering the handle 114 instead of, or in addition to, the moveable spray head 116. Still other examples may include defining the slot 142 with the moveable spray head 116.

In this example, to dock the handheld shower 112, a user positions the narrower end portion 158 of the moveable spray head within the wider end portion 154 of the slot 142 and then slides the moveable spray head 116 in the direction shown. In an engaged position, the moveable spray head 116 contacts at least some of the sides of the fixed spray head 118 that define the slot 142, which limits further movement of the handheld shower 112 in the direction shown.

Removing the handheld shower 112 from the fixed spray head 118 allows the user to direct spray from the handheld shower 112 to other portions of the bathing area. A user slides the handheld shower 112 within the slot 142 opposite the direction shown to remove the handheld shower 112.

In this example, some of the sides that define the slot 142 include tabs 160, which are received within apertures 162 defined by the moveable spray head 116 when the handheld shower 112 is in the docked or engaged position within the slot 142. The tabs 160 limit inadvertent disengagement of the moveable spray head 116 from the fixed spray head 118 and facilitate an aligned relationship between the handheld shower 112 and the fixed spray head 118 when the handheld shower 112 is docked.

The handle 114 on the moveable spray head 116 includes a valve control feature 164 that, when moved, actuates a valve (not shown) within the handheld shower 112 to control water flow through a plurality of apertures 168. In this example, the fixed spray head 118 also includes a plurality of apertures 172 that provide a spray of water separate from the spray of water exiting the handheld shower 112.

Referring now to FIGS. 4A-5B, another example shower assembly 210 includes a handheld shower 212 having a handle 214 extending from a moveable spray head 216. The moveable spray head 216 is removeably docked with a fixed spray head 218, a type of base. The water supply 22 delivers water to the moveable spray head 216 and the fixed spray head 218 through a water supply tube 226, which is fixed relative to the bathing area wall 120. A mounting bracket 234 is secured to the water supply tube 226 and receives water from the water supply 22. The fixed spray head 218 includes the mounting bracket 234, in this example. A threaded connection 238 secures the mounting bracket 234 to the water supply tube 226.

The fixed spray head 218 defines a slot 242 that receives the moveable spray head 216. The slot 242 tapers from a wider end portion 246 to a narrower end portion 250. The handheld shower 212 includes a section that similarly tapers from a wider end portion 254 to a narrower end portion 258. In this example, the profile of this section of the handle 214 is the same general profile as that of the slot 242. The fixed portion may be held exclusively by the neck portion of the handheld shower and the fixed portion may be spaced from other areas of the handheld shower.

To dock the handheld shower 212 with the fixed spray head 218, the user positions the narrower end portion 258 of the handheld shower 212 within the wider end portion 246 of the slot 242, and then slides the handheld shower 212 within the slot 242 in the direction shown. In this example, the handheld shower 212 contacts the sides of the fixed spray head 218 that define the slot 242 to limit further movement of the handheld shower 212 in the direction shown. The moveable spray head 216 also contacts the fixed spray head 218 to limit movement as the fixed spray head 218 includes the wider end portion 246. The user slides the handheld shower 212 within the slot in an opposite direction to remove the handheld shower 212. The fixed spray head 218 may include a plurality of tabs 262 or extensions for stabilizing the handheld shower 212 when docked or when the handheld shower 212 is moving to the docked position.

A valve control 264 on the moveable spray head 216 actuates a valve (not shown) within the fixed spray head 218 to control water flow through a plurality of apertures 268. In this example, both the fixed spray head 218 and the moveable spray head 216 include some of the plurality of apertures 268.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A shower assembly comprising:

a fixed base having a first set of apertures for spraying water upon a user, said base having a cover enclosing a back portion of said first set of apertures and defining an opening;

a magnet disposed between said cover and said first set of apertures, wherein said magnet includes a plurality of magnets annularly arranged about an axis defined by the base, the plurality of magnets each spaced from the axis and each other; and a moveable spray head for docking in said opening said spray head having a plate defining a second set of apertures that direct a spray of water from the moveable spray head wherein said magnet attracts the plate to hold the moveable spray head relative to the base.

2. The shower assembly of claim 1, wherein both the base and the moveable spray head define apertures for controlling water spray.

3. The shower assembly of claim 1, wherein the base defines a recess that accommodates the magnets.

4. The docking arrangement of claim 1, wherein the apertures of the plate are disposed at varying diameters relative to an axis passing through said plate and said cover.

5. The shower assembly of claim 1, wherein the plate threadably attaches to the movable spray head.

6. A shower assembly comprising:

a fixed base having a first set of apertures for spraying water upon a user, said base having a cover enclosing a back portion of said first set of apertures and defining an opening;

a moveable spray head disposed in said opening;

at least one clip extending from at least one of the base and the moveable spray head, wherein the clip is received within a groove defined by the other one of the base and the moveable spray head to hold the moveable spray head relative to the base; and at least one magnet that attracts a plate to hold the moveable spray head relative to the base.

7. The shower assembly of claim 6, wherein the at least one clip is flexible relative to the at least one of the base and the moveable spray head.

8. A docking arrangement for a handheld shower comprising:

a base;

a handheld shower extending longitudinally in a first direction; and a tapered section that tapers from a first width at a top thereof to a second width smaller than the first width at a bottom thereof, wherein at least one of the base and the handheld shower includes the tapered section and the other of the base and the handheld shower defines a slot for receiving the tapered section, wherein the tapered portion contacts the other of the base and the handheld shower to limit movement of the handheld shower away from the base downwardly, wherein the handheld shower is free to move upwardly when the tapered portion contacts the other of the base and the handheld shower.

9. The docking arrangement of claim 8, wherein both the handheld shower and the base define apertures for controlling a spray of water.

10. The docking arrangement of claim 8, wherein the slot is a longitudinal slot that tapers from a larger slot portion at a top of said base to a smaller slot portion, wherein the smaller slot portion is narrower than the first width.

11. The docking arrangement of claim 8, wherein the handheld shower includes the tapered section.

12. The docking arrangement of claim 11, wherein the handheld shower comprises a moveable spray head that includes the tapered section.

13. The docking arrangement of claim 8, wherein the tapered section includes tabs that are received within apertures to limit relative movement between the base and the handheld shower.

14. A handheld shower docking arrangement comprising:

a handheld shower having a neck portion and a head portion; and a fixed portion for holding the handheld shower, the fixed portion defining a notch for receiving the neck portion and an open area for receiving the head portion, the handheld shower contacting the fixed portion to limit movement of the handheld shower away from the base when the handheld shower is moved within the notch in a downwardly, wherein the fixed portion holds exclusively the neck portion of the handheld shower and the fixed portion is spaced from other areas of the handheld shower.

15. The docking arrangement of claim 14, wherein the notch receives the neck portion of the handheld shower and the head portion contacts the base to limit movement of the handheld shower away from the fixed portion.

16. The docking arrangement of claim 15, wherein the fixed portion is configured to pivot relative to a water supply pipe.

* * * * *